US007071893B2

(12) United States Patent
Maruoka

(10) Patent No.: US 7,071,893 B2
(45) Date of Patent: Jul. 4, 2006

(54) ANTENNA DEVICE

(75) Inventor: Satoshi Maruoka, Tomioka (JP)

(73) Assignee: Yokowo Co., LTD, Tokyo (JP)

( * ) Notice: Subject to any disclaimer, the term of this patent is extended or adjusted under 35 U.S.C. 154(b) by 0 days.

(21) Appl. No.: 10/516,885

(22) PCT Filed: Jun. 2, 2003

(86) PCT No.: PCT/JP03/06938

§ 371 (c)(1),
(2), (4) Date: Sep. 6, 2005

(87) PCT Pub. No.: WO03/105275

PCT Pub. Date: Dec. 18, 2003

(65) Prior Publication Data

US 2006/0097938 A1 May 11, 2006

(30) Foreign Application Priority Data

Jun. 3, 2002 (JP) ..... 2002-161766

(51) Int. Cl.
*H01Q 1/12* (2006.01)

(52) U.S. Cl. ..... 343/888; 343/715; 343/702

(58) Field of Classification Search ..... 343/888, 343/715, 702, 906, 900, 880, 882; H01Q 1/12
See application file for complete search history.

(56) References Cited

U.S. PATENT DOCUMENTS 4,115,779 A * 9/1978 Dantzler et al. ..... 343/715
4,785,305 A * 11/1988 Shyu ..... 343/713
6,853,340 B1 * 2/2005 Wang ..... 343/715

FOREIGN PATENT DOCUMENTS

JP 56-050105 U 5/1981
JP 63-040890 Y2 10/1988
JP 63-040891 Y2 10/1988
JP 06-015353 U 2/1994
JP 07-221523 A 8/1995

* cited by examiner

*Primary Examiner*—Hoanganh Le
(74) *Attorney, Agent, or Firm*—Birch, Stewart, Kolasch & Birch, LLP

(57) ABSTRACT

The present invention provides an antenna device capable of retaining by a simple structure an antenna base end portion 12 pivotably and, moreover, in a predetermined posture on an antenna base member 10. The antenna base member 10 is provided therein coaxially with a cylindrical member 10*d* a part of a circumferential wall of which is cut off. The cylindrical member 10*d* is provided therein with a substantially annular elastic member 16, which has an engagement projection 16*a* extending outward from the cutoff portion in the radial direction and capable of being elastically displaced in the radial direction, in such a manner that the elastic member is not relatively turned. The antenna base end portion 12 is provided with an engagement recess 12*a* engaged with an outer circumference of the cylindrical member 10*d*, and the engagement projection 16*a* is elastically engaged with an inner circumferential surface of the engagement recess 12*a*. The engagement recess 12*a* is provided in an inner circumferential surface thereof with retaining recesses 12*b*, 12*c* with which the engagement projection 16*a* is elastically engaged with an antenna in predetermined postures substantially horizontal and of a predetermined angle of inclination. The engagement recess 12*a* is fitted around an outer circumference of the cylindrical member 10*d*, and the antenna base end portion 12 is provided pivotably on the antenna base member 10.

5 Claims, 10 Drawing Sheets

(a)

(b)

(c)

ANTENNA DEVICE

This application is a 371 of PCT/JP03/06938 filed on Jun. 2, 2003 and claims priority benefits of Japanese Patent Application No. 2002-161766 filed Jun. 3, 2002.

TECHNICAL FIELD

This invention relates to an antenna device formed so that an antenna can be moved pivotally on an antenna base member and, moreover, retained in a predetermined posture.

BACKGROUND ART

In a related art example of an antenna device formed so that an antenna can be moved pivotally on an antenna base member and, moreover, retained in a predetermined posture, a pivot is passed through each of a fixed clutch plate secured to the antenna base member and having recesses and projections like those of a clip washer, and a movable clutch plate secured to a base end portion of the antenna and having recesses and projections like those of a clip washer, and the movable clutch plate is elastically engaged with the fixed clutch by a compression coiled spring loosely fitted around the pivot. Since the recesses and projections of the fixed clutch and movable clutch are meshed with one another, a predetermined posture of the antenna is retained. When the disengaging of the recesses and projections of the fixed clutch plate and those of the movable clutch plate from one another is done against an elastic force of the compression coiled spring, the antenna can be turned.

However, in this related art antenna device, the number of parts of a mechanism for retaining the antenna in a predetermined posture including the fixed clutch, movable clutch and compression coiled spring is large. This causes the construction of the related art antenna device to become complicated, and the weight thereof to increase.

Therefore, the present invention has been made in view of such circumstances, and aims at providing an antenna device having a simple construction of the mechanism for retaining the antenna in a predetermined posture.

DISCLOSURE OF THE INVENTION

The antenna device according to the present invention is an antenna device in which an antenna base end portion is provided pivotably with respect to an antenna base member with an antenna retained in a predetermined posture, one of the antenna base member and antenna base end portion being provided with an elastic member having an engagement section capable of being elastically displaced in the radial direction with respect to an axis of a pivotal movement thereof so that the elastic member is not relatively turned, the other of the antenna base member and antenna base end portion being provided with a slide engagement section with which the elastic member elastically deformed by a turning movement of the antenna is slidingly engaged, the slide engagement section being provided with a retaining part with which the mentioned engagement section is engaged by the elastic force of the elastic member with the antenna in a predetermined posture. In this structure, the engagement section provided on one of the pivotably provided antenna base member and antenna base end portion engages the retaining part, which is provided on the other, by the elastic force of the elastic member to thereby enable the antenna to be retained in a predetermined posture. One elastic member can form a click mechanism simply, so that the construction of the antenna device is very simple.

In the antenna device in which an antenna base end portion is provided pivotably with respect to an antenna base member with an antenna retained in a predetermined posture, the antenna base member being provided with an elastic member having an engagement projection which extends radially with respect to an axis of a pivotal movement of the antenna, and which can be elastically deformed in the radial direction, in such a manner that the elastic member is not turned relatively, the antenna base end portion being provided with a slide engagement section with which the engagement projection elastically deformed by a turning movement of the antenna is slidingly engaged, the slide engagement section being allowable to be provided with a retaining recess with which the engagement projection is engaged by an elastic force thereof with the antenna in a predetermined posture. The engagement projection of the elastic member provided on the antenna base member engages the retaining recess provided in the slide engagement section of the antenna base portion to thereby enable the antenna to be retained in a predetermined posture.

In the antenna device in which an antenna base end portion is provided pivotably with respect to an antenna base member with an antenna retained in a predetermined posture, the antenna base end portion being provided with an elastic member having an engagement projection which extends radially with respect to an axis of a pivotal movement of the antenna, and which can be elastically deformed in the radial direction, in such a manner that the elastic member is not turned relatively, the antenna base member being provided with a slide engagement section with which the engagement projection elastically deformed by a turning movement of the antenna is slidingly engaged, the slide engagement section being allowable to be provided with a retaining recess with which the engagement projection is engaged by an elastic force thereof with the antenna in a predetermined posture. The engagement projection of the elastic member provided on the antenna base end portion engages the retaining recess provided in the slide engagement section of the antenna base member to thereby enable the antenna to be retained in a predetermined posture.

The antenna device can also be formed by further providing the antenna base member with a cylindrical member a part of an outer circumferential surface of which is cutoff, providing a substantially annular elastic member, which has an engagement projection extending in the radial direction of the cutoff portion, in the cylindrical member, providing the antenna base end portion with an engagement recess engaged with the outer circumferential surface of the cylindrical member and thereby forming an inner circumferential surface thereof into the slide engagement section, and providing an inner circumferential surface of the engagement recess with a retaining recess with which the engagement projection is engaged. This enables the antenna device to be formed by incorporating the whole of the click mechanism in the antenna base end portion.

The annular elastic member may be provided therein with urethane rubber in a compressed state so that the urethane rubber is elastically engaged with a bottom surface of the engagement recess of the antenna base end portion. When the antenna is turned in this structure, a suitable pivotal resistance is obtained owing to a frictional resistance caused by the elastic engagement of the urethane rubber.

BEST MODE FOR CARRYING OUT THE INVENTION

Figure 1:
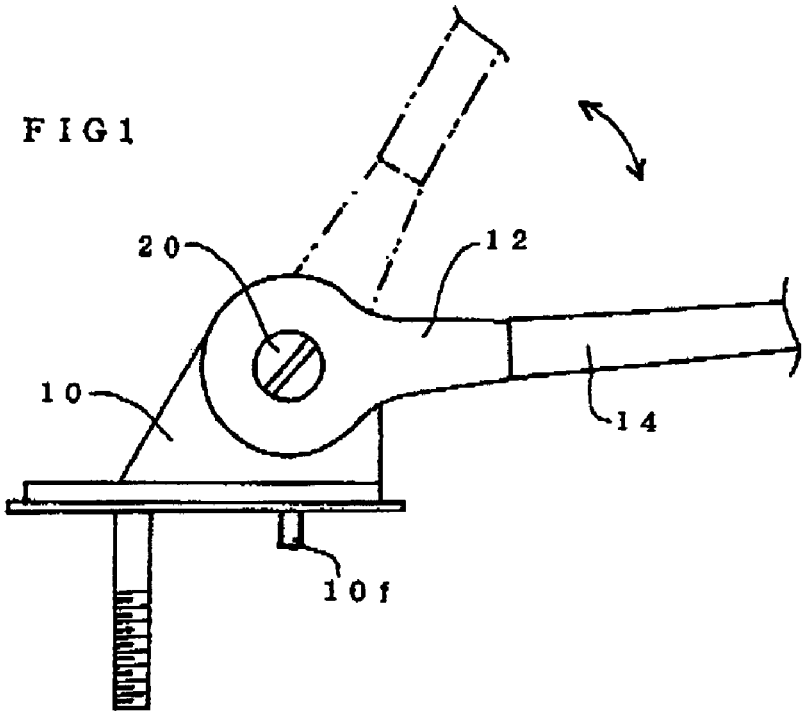
FIG. 1 is a front view of a first embodiment of the antenna device according to the present invention.
Figure 2:
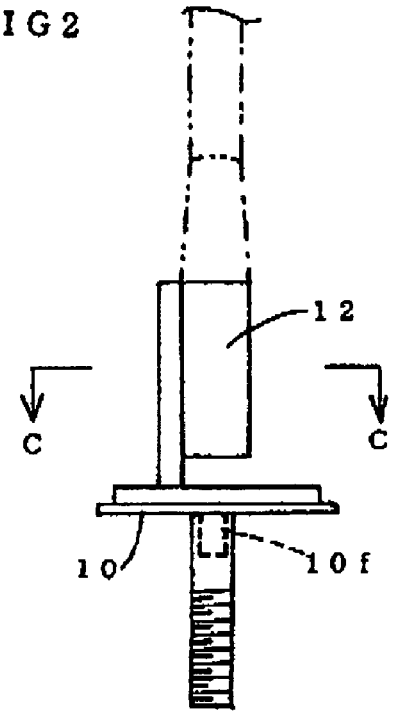
FIG. 2 is a left side view of what is shown in FIG. 1.
Figure 3:
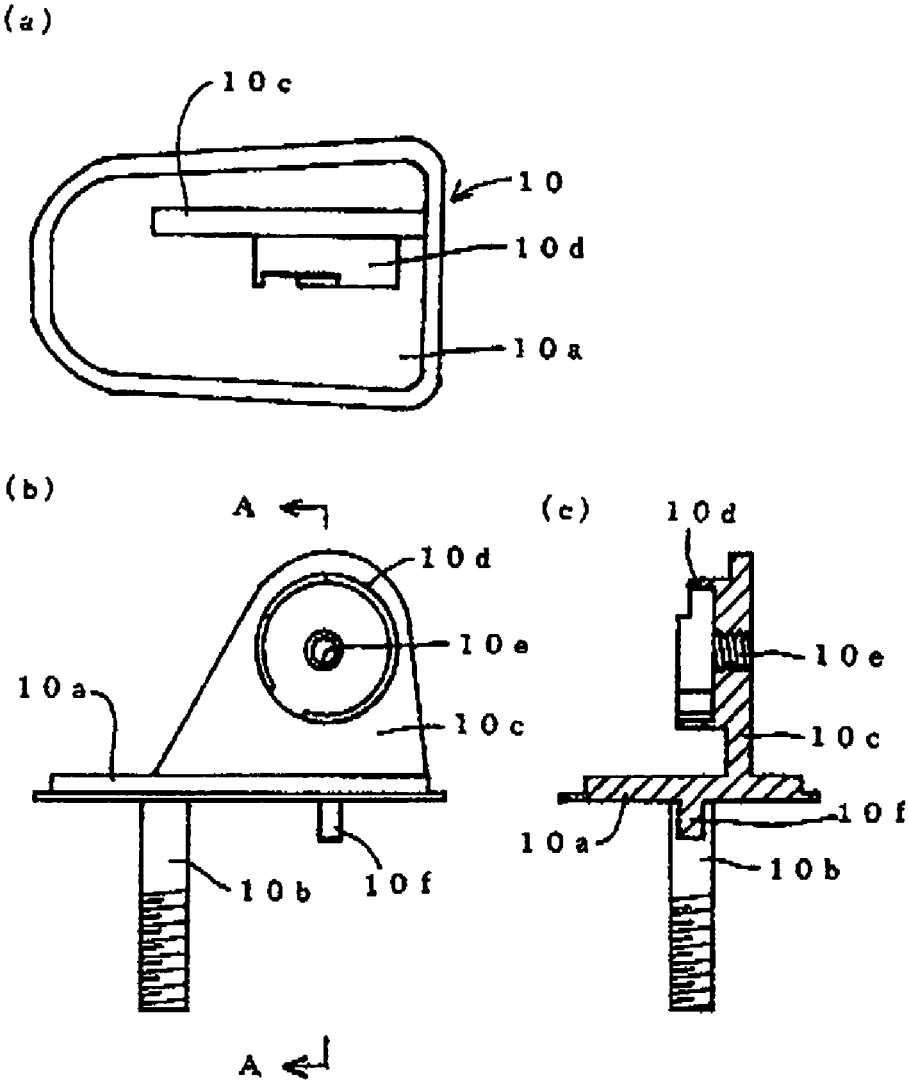
FIG. 3 shows an antenna base member, wherein FIG. 3(*a*) is a plan view, FIG. 3(*b*) a front view, and FIG. 3(*c*) a sectional view taken along the arrow-carrying line A—A in FIG. 3(*b*)
Figure 4:
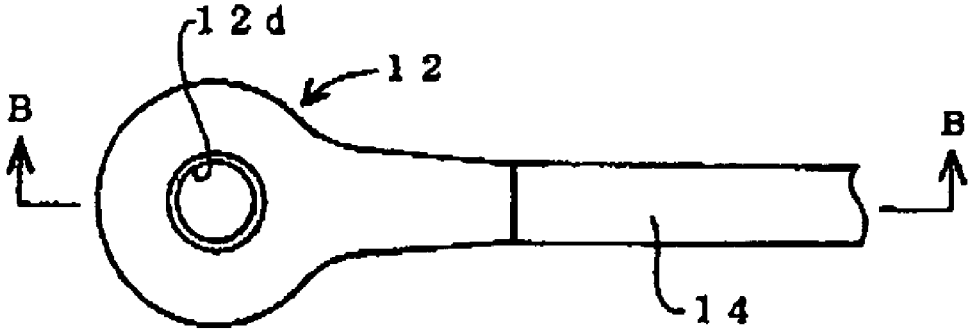
FIG. 4 shows an antenna base end portion, wherein FIG. 4(*a*) is a plan view, FIG. 4(*b*) a sectional view taken along the arrow-carrying line B—B in FIG. 4(*a*), and FIG. 4(*c*) a rear view.
Figure 4:
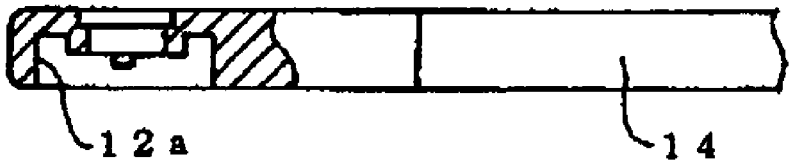
Figure 4:
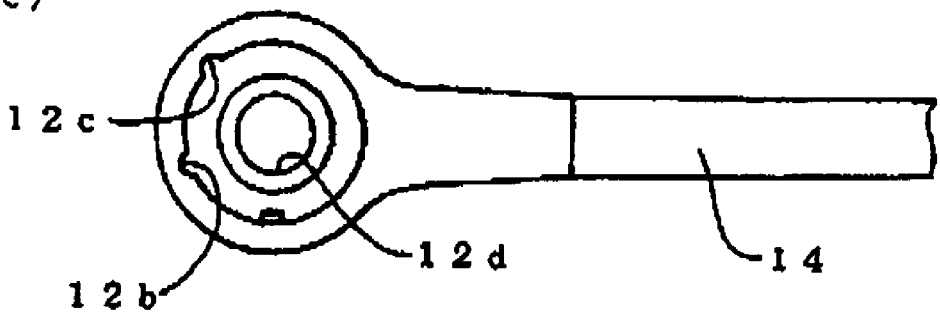
Figure 5:
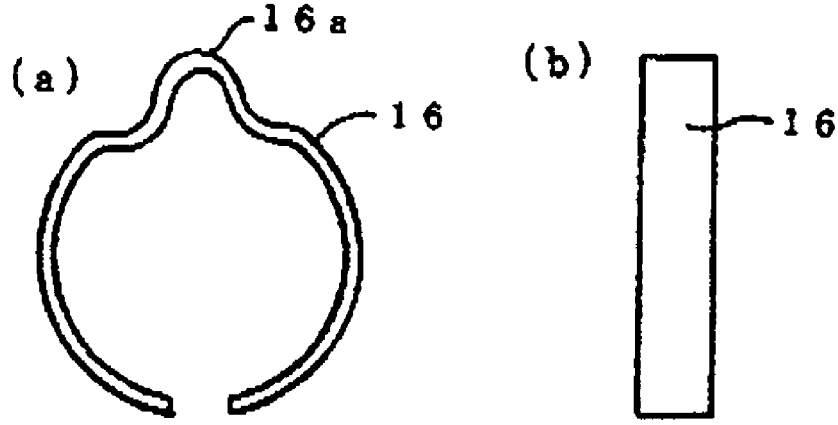
FIG. 5 shows an elastic member, wherein FIG. 5(*a*) is a front view, and FIG. 5(*b*) a side view.
Figure 6:
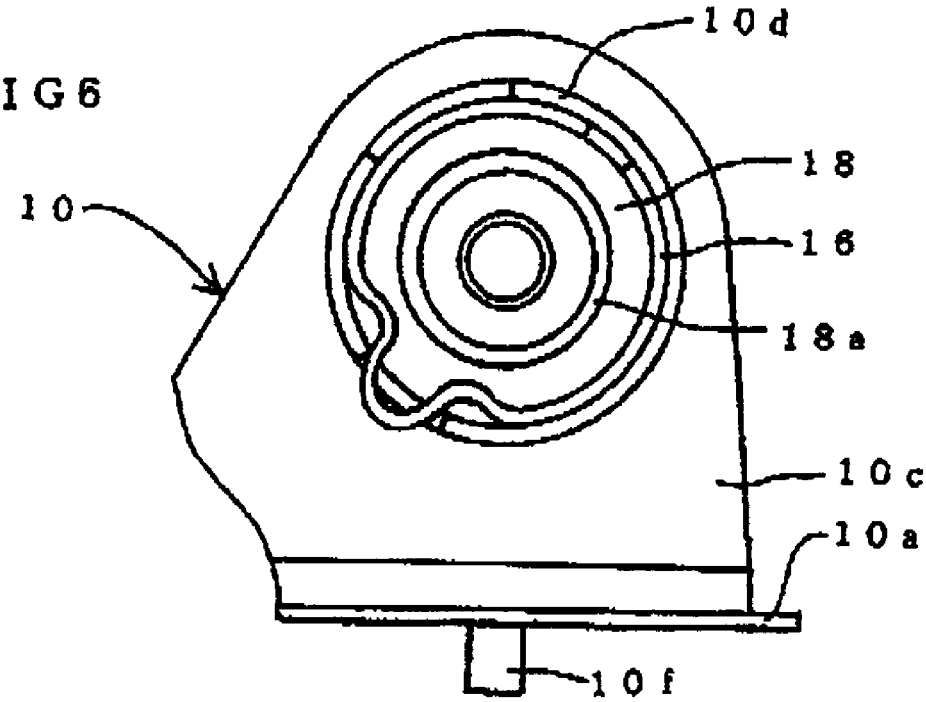
FIG. 6 is a partial front view showing the elastic member and urethane rubber combined with the antenna base member.
Figure 7:
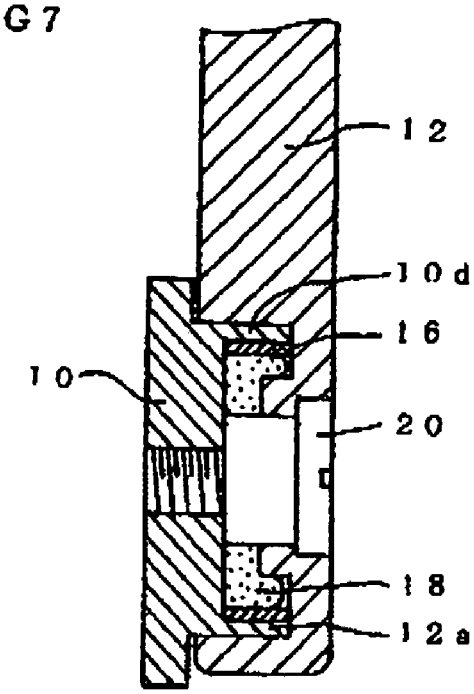
FIG. 7 is a sectional view of the antenna end portion viewed from the above along the arrow-carrying line C—C in FIG. 2.
Figure 8:
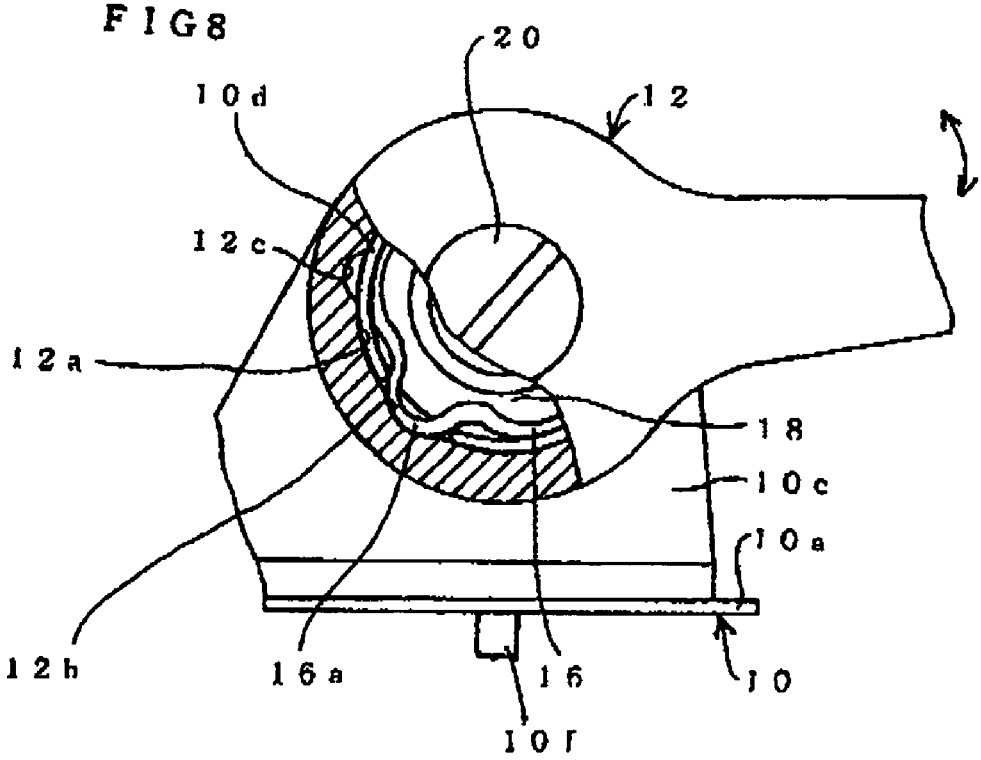
FIG. 8 is a partially cutaway front view showing the condition of a part of the antenna retained in a predetermined posture.
Figure 9:
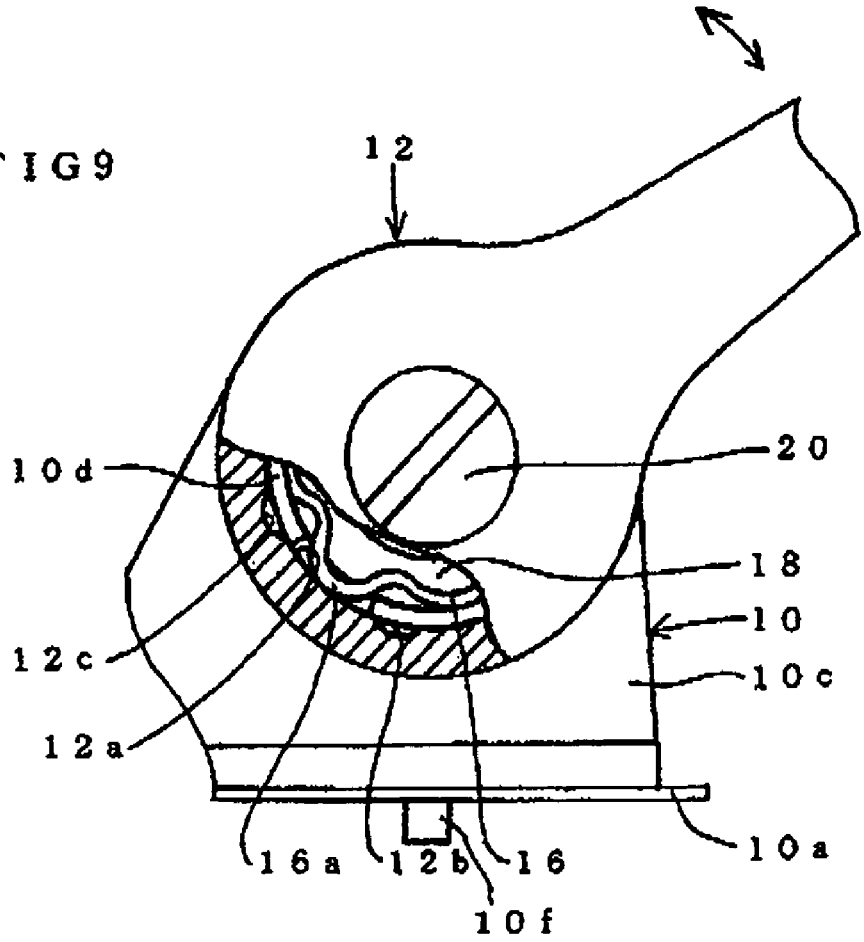
FIG. 9 is a partially cutaway front view showing the condition of a part of the antenna not retained in a predetermined posture but in a turning movement.

A first embodiment of the present invention will now be described with reference to FIGS. 1 to 9. FIG. 1 is a front view of the first embodiment of the antenna device according to the present invention. FIG. 2 is a left side view of what is shown in FIG. 1. FIG. 3 shows an antenna base member, wherein FIG. 3(*a*) is a plan view, FIG. 3(*b*) a front view, and FIG. 3(*c*) a sectional view taken along the arrow-carrying line A—A in FIG. 3(*b*). FIG. 4 shows an antenna base end portion, wherein FIG. 4(*a*) is a front view, FIG. 4(*b*) a sectional view taken along the arrow-carrying line B—B in FIG. 4(*a*), and FIG. 4(*c*) a rear view. FIG. 5 shows an elastic member, wherein FIG. 5(*a*) is a front view, and FIG. 5(*b*) a side view. FIG. 6 is a partial front view showing the elastic member and urethane rubber combined with the antenna base portion. FIG. 7 is a sectional view of the antenna base end portion viewed from the above along the arrow-carrying line C—C in FIG. 2. FIG. 8 is a partially cutaway front view showing the condition of an antenna retained in a predetermined posture. FIG. 9 is a partially cutaway front view showing the condition of the antenna not retained in a predetermined posture but in a turning movement. FIGS. 5 to 9 are drawn in a doubly magnified state with respect to FIGS. 1 to 4.

Referring to FIGS. 1 to 9, an antenna base member 10 is provided with a downwardly directed fixing bolt 10*b* on a base 10*a*, and a standing portion 10*c* on the upper side thereof, a cylindrical member 10*d* a part of an outer circumferential surface of which is cut off being provided on this standing portion 10*c* so that the axis of the cylindrical member 10*d* extends horizontally, a threaded hole 10*e* being provided in the section of the standing portion 10*c* which corresponds to the axis of the cylindrical member 10*d*. A reference numeral 10*f* denotes a boss inserted into a hole, which is provided in a vehicle body, so as to prevent the antenna base member 10 from being rotated around the fixing bolt 10*b* as a shaft. The antenna base end portion 12 is provided with an engagement recess 12*a* engageable with an outer circumference of the cylindrical member 10*d*, and an inner circumferential surface of the engagement recess 12*a* with retaining recesses 12*b*, 12*c*, a bolt hole 12*d* being provided in an axial section of the antenna base end portion. The antenna base end portion 12 is provided with a base end portion of a rod type antenna element 14 fixed thereto suitably. The cylindrical member 10*d* is provided with a cutoff portion at apart of an edge thereof, and a projection on an inner surface of the engagement recess 12*a* so as to be opposed to the cutoff portion.

As shown in FIG. 6, the cylindrical member 10*d* of the antenna base member 10 is provided therein with an elastic member 16 having an engagement projection 16*a* which extends from the cutoff portion of the cylindrical member 10*d* in the radial direction, and made of a partially cut-off substantially annular plate spring. This elastic member 16 is elastically engaged with the inner circumferential surface of the cylindrical member 10*d*. The elastic member 16 is provided on the inner side thereof with compressed urethane rubber 18. An outer circumferential surface of this urethane rubber 18 is engaged with the inner side of the elastic member 16, and a bolt hole is made in an axial portion of the urethane rubber.

The engagement recess 12*a* of the antenna base end portion 12 is fitted around the outer circumference of the cylindrical member 10*d* of the antenna base member 10 with which the elastic member 16 and urethane rubber 18 are combined. A fixing bolt 20 is then screwed from the bolt hole 12*d* into the threaded hole 10*e* to thereby combine as shown in FIG. 7 the antenna base end portion with the antenna base member 10 so that the antenna base end portion does not separate therefrom. The fixing bolt 20 thus fixed to the antenna base member 10 is primarily used to prevent the separation of the antenna base end portion 12, and can be relatively turned with respect to the antenna base end portion 12, the fixing bolt working also as a pivot. The outer circumference of the cylindrical member 10*d* around which the engagement recess 12*a* is fitted also works as a pivot of the antenna base end portion 10. In this structure, owing to the cutoff port ion provided at apart of an edge of the cylindrical member 10*d*, a turning movement of the projection of the antenna base end portion 12 is restricted, so that an angle of a turning movement of the antenna base end portion 12 is restricted. The urethane rubber 18 may be provided on a side surface thereof with a projection 18*a* (shown in FIG. 6), which can be deformed elastically with ease, in such a manner that this projection 18*a* contacts a bottom surface of the engagement recess 12*a* of the antenna base end portion 12. In the assembled condition of FIG. 7, the projection 18*a* is deformed elastically to perfection and cannot be recognized.

When, in this structure, the position of the engagement projection 16*a* of the elastic member 16 extending from the cutoff portion of the antenna base member 10 is aligned with that of one retaining recess 12*b* of the inner circumferential surface of the engagement recess 12*a* of the antenna base end portion 12 as shown in FIG. 8, the engagement projection 16*a* is engaged elastically with the retaining recess 12*b*, so that the antenna base end portion 12 is retained in a predetermined posture with respect to the antenna base member 10. In FIG. 8, the condition of the antenna retained substantially horizontally is shown.

When an upward turning force (anti-clockwise force in FIG. 8) is exerted on the antenna in a substantially horizontal predetermined posture, the elastic member 16 is elastically deformed with respect to a force of a level not lower than a certain level, and the position of the engagement projection 16*a* is shifted so that the engagement projection radially retracts to cause the engagement projection 16*a* to disengage from the retaining recess 12*b*. Owing to a further force exerted in the antenna turning direction, as shown in FIG. 9, the engagement projection 16*a* is elastically engaged with the engagement projection 16*a* left in the elastically displaced state with the inner circumferential surface of the engagement recess 12*a*, and the turning of the antenna is thus allowed. During this time, the inner circumferential surface of the engagement recess 12*a* works as a slide engagement portion with which the engagement projection 16*a* is slidingly engaged.

When the antenna is turned to a position in which the antenna attains a predetermined posture of an angle of inclination of, for example, 45° at which an optimum reception sensitivity is obtained, the engagement projection 16*a* is engaged with the other retaining recess 12*c* in an opposed state which is provided in the inner circumferential surface of the engagement recess 12*a*. Therefore, the antenna is retained in a predetermined posture of a suitable angle of inclination.

In the above-described first embodiment, the so-called click mechanism for retaining the antenna in a predetermined posture is formed by the elastic member 16 made of a plate spring. Therefore, the construction of the click mechanism is very simple, and the number of the parts thereof is small. Owing to the urethane rubber 18 provided on the inner side of the elastic member 16, the elastic deformation of the elastic member 16 is somewhat restricted. Accordingly, the impression of a click sound is rendered more certain, and the vibration and the like of the parts of the antenna do not cause the antenna to be put in a non-retained state. Since the urethane rubber 18 is elastically engaged with the bottom surface portion of the engagement recess 12*a* of the antenna base end portion 12, a suitable turning resistance can be obtained owing to the frictional resistance occurring when the antenna is turned. In the first embodiment, the antenna can be formed with the click mechanism as a whole incorporated in the antenna base end portion 12. In order to obtain a suitable frictional resistance owing to the elasticity of the urethane rubber 18, the engagement portion thereof may have any cross-sectional shape. In order to prevent wear from occurring on the urethane rubber 18 in the engagement portion thereof, grease and the like may be applied to the engagement surface.

Figure 10:
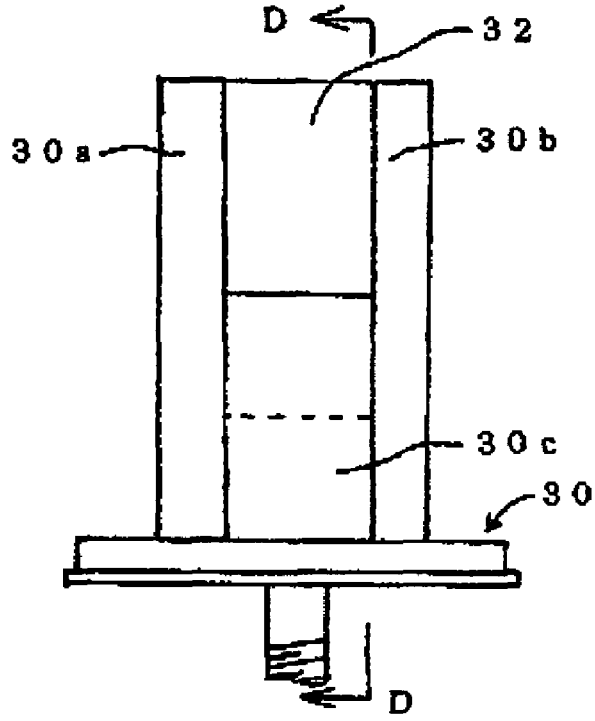
FIG. 10 is a left side view of a second embodiment of the antenna device according to the present invention.
Figure 11:
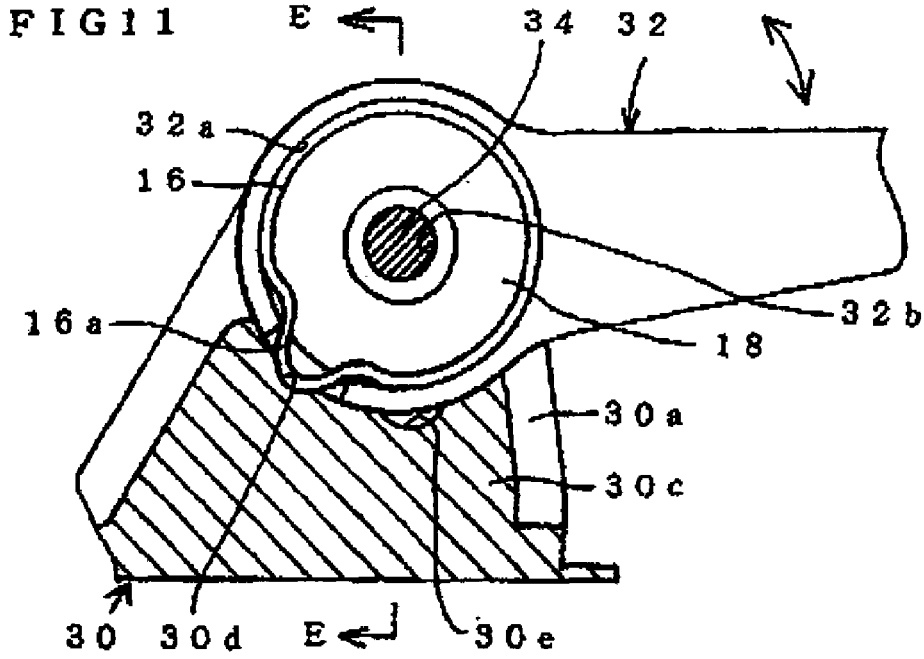
FIG. 11 is a sectional view taken along the arrow-carrying line D—D in FIG. 10.
Figure 12:
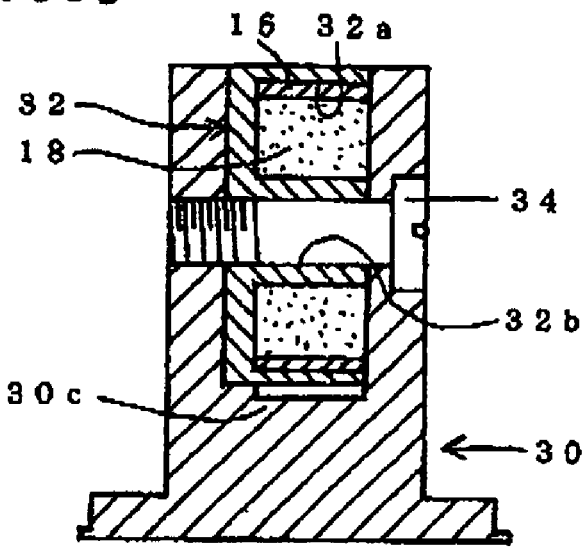
FIG. 12 is a sectional view taken along the arrow-carrying line E—E in FIG. 11.

A second embodiment of the present invention will now be described with reference to FIGS. 10 to 12. FIG. 10 is a left side view of the second embodiment of the antenna device according to the present invention. FIG. 11 is a sectional view taken along the arrow-carrying line D—D in FIG. 10. FIG. 12 is a sectional view taken along the arrow-carrying line E—E in FIG. 11.

Referring to FIGS. 10 to 12, an antenna base member 30 is provided thereon with a pair of standing portions 30*a*, 30*b*, and an antenna base end portion 32 inserted between the standing portions is set pivotable via a fixing bolt 34 as a pivot. The antenna base end portion 32 is provided in one side surface thereof with an annular recess 32*a*, and a part of a circumferential portion of an outer side wall of this annular recess 32*a* is cut off. An inner side wall of the annular recess 32*a* is provided at an axial portion thereof with a bolt hole 32*b* through which the fixing bolt 34 can be inserted. A substantially annular elastic member 16 made of a plate spring is provided so that the elastic member is elastically engaged with the outer sidewall of the annular recess 32*a*. An engagement projection 16*a* of this elastic member 16 extends from the cutoff portion of the annular recess 32*a* in the radially outward direction.

Furthermore, compressed urethane rubber 18 is suitably packed in the annular recess 32*a* on the inner side of the elastic member 16.

Between the two standing portions 30*a*, 30*b* of the antenna base member 30, a slide engagement portion 30*c*, with which the engagement projection 16*a* is slidingly engaged, is provided so as to extend along a circular outer circumferential surface of the antenna base portion 32. This slide engagement portion 30*c* is provided with retaining recesses 30*d*, 30*e* opposed to the engagement projection 16*a* extending outward from the cutoff portion with the antenna in a predetermined posture.

In the second embodiment, the engagement projection 16*a* is also elastically engaged with the opposed retaining recesses 30*d*, 30*e* in the same manner as in the first embodiment to retain the antenna in a predetermined posture. The engagement projection 16*a* is disengaged from the retaining recesses 30*d*, 30*e* by a force of a level not lower than a predetermined level of a force working in the antenna turning direction, and thereby allows the antenna to be turned. In the first embodiment, the elastic member 16 is provided on the antenna base member 30, while, in the second embodiment, the elastic member 16 is provided on the antenna base end portion 32.

Figure 13:
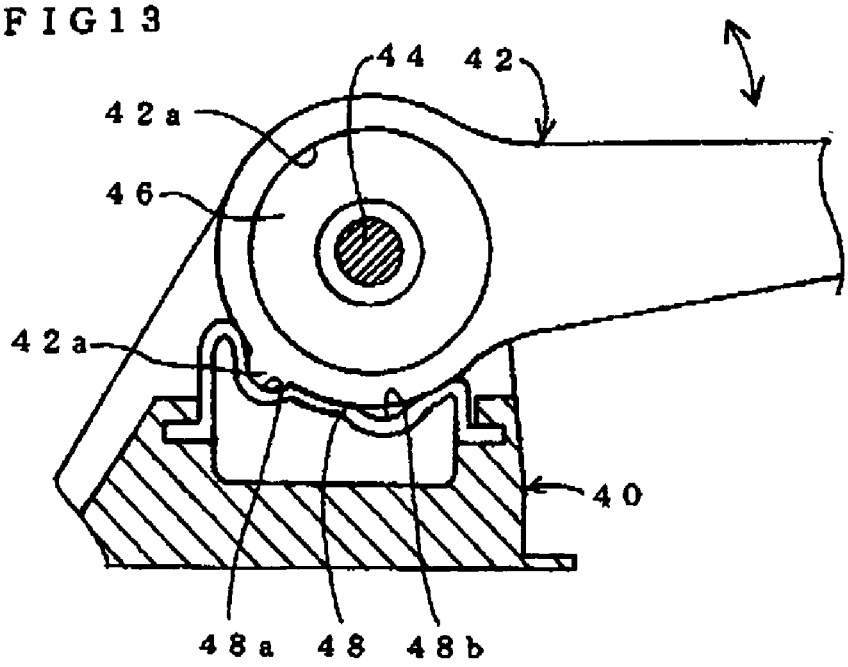
FIG. 13 is a longitudinal sectional view of a third embodiment of the antenna device according to the present invention.

A third embodiment of the present invention will now be described with reference to FIG. 13. FIG. 13 is a longitudinal sectional view of the third embodiment of the antenna device according to the present invention. FIG. 13 is taken along a line similar to the line D—D in FIG. 10.

Referring to FIG. 13, an antenna base end portion 42 is provided suitably on an antenna base member 40 by a fixing bolt 44 so that the antenna base end portion can be turned. This antenna base end portion 42 is provided therein with an annular recess 42*a* coaxial with the fixing bolt 44, and compressed urethane rubber 46 is suitably packed therein. The antenna base end portion 42 is further provided on a substantially circular outer circumferential surface thereof with a retaining projection 42*b* extending radially outward. The antenna base member 40 is provided with an elastic member 48, which is made of a plate spring working as a slide engagement portion so that the elastic member is slidingly engaged with the circular outer circumferential surface of the antenna base end portion 42, in such a manner that the elastic member 48 can be deformed elastically in the radial direction. This elastic member 48 is provided in the portions thereof to which the retaining projection 42*b* is opposed with the antenna in a predetermined posture with engagement recesses 48*a*, 48*b* so that the elastic member can be elastically deformed in the radial direction.

In the third embodiment of such a construction, the retaining projection 42*b* is engaged with the engagement recess 48*a* with the antenna in a predetermined posture in which the retaining projection 42*b* is opposed to the engagement recess 48*a* of the elastic member 48, so that the predetermined posture is retained. When a force the level of which is not lower than a predetermined level is exerted on the antenna so as to turn the same, the elastic member 48 is elastically deformed to cause the retaining projection 42*b* to disengage from the engagement recess 48*a*, and a turning movement of the antenna is allowed. When the retaining projection 42*b* is in a position in which the retaining projection is opposed to the other engagement recess 48*b*, the retaining projection 42*b* is engaged with the engagement recess 48*b*, and the antenna is retained in the other predetermined posture. Even in the structure of this third embodiment, a simply shaped elastic member 48 forms a click mechanism.

Figure 14:
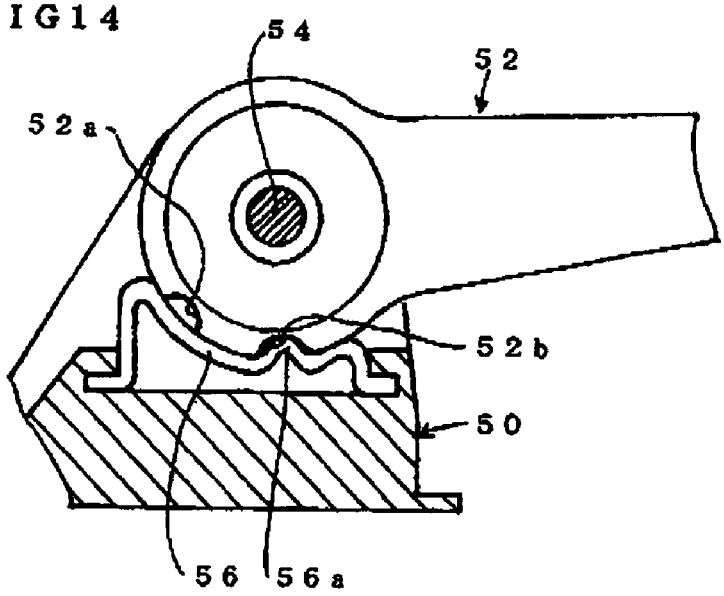
FIG. 14 is a longitudinal sectional view of a fourth embodiment of the antenna device according to the present invention.

A fourth embodiment of the present invention will now be described with reference to FIG. 14. FIG. 14 is a longitudinal sectional view of the fourth embodiment of the antenna device according to the present invention. FIG. 14 is taken along a line similar to the line D—D in FIG. 10.

Referring to FIG. 14, an antenna base end portion 52 is provided suitably on an antenna base member 50 by a fixing bolt 54 so that the antenna base end portion 52 can be turned. This antenna base end portion 52 is provided in a substantially circular outer circumferential surface thereof with retaining recesses 52*a*, 52*b*. The antenna base member 50 is provided thereon with an elastic member 56, which is made of a plate spring, in such a manner that the elastic member is slidingly engaged with an outer circumferential surface of the antenna base end portion 52. This elastic member 56 is provided with an engagement projection 56*a*, which is elastically displaced in the radial direction, in such a manner that the engagement projection extends toward the center of the antenna base end portion.

When, in the fourth embodiment of such a construction, the antenna is in a predetermined posture in which the retaining recesses 52*a*, 52*b* in the outer circumferential surface of the antenna base end portion are opposed to the engagement projection 56*a* of the elastic member 56, the engagement projection 56*a* engages the retaining recesses 52*a*, 52*b*, so that the antenna retains the predetermined posture. When a force the level of which is not lower than a predetermined level is exerted on the antenna so as to turn the same, the elastic member 56 is elastically deformed to disengage from the retaining recesses, and a turning movement of the antenna is allowed.

Figure 15:
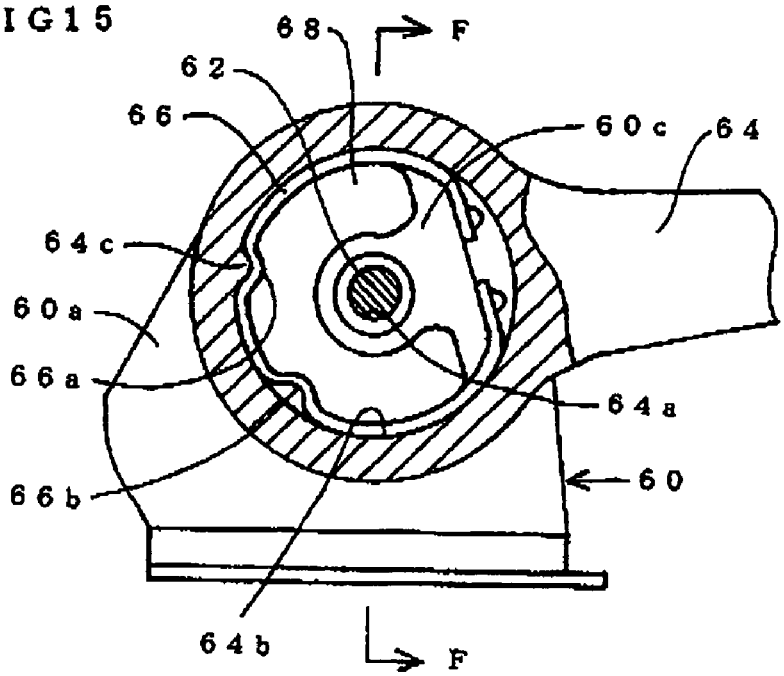
FIG. 15 is a partially cutaway view of a part of a fifth embodiment of the antenna device according to the present invention.
Figure 16:
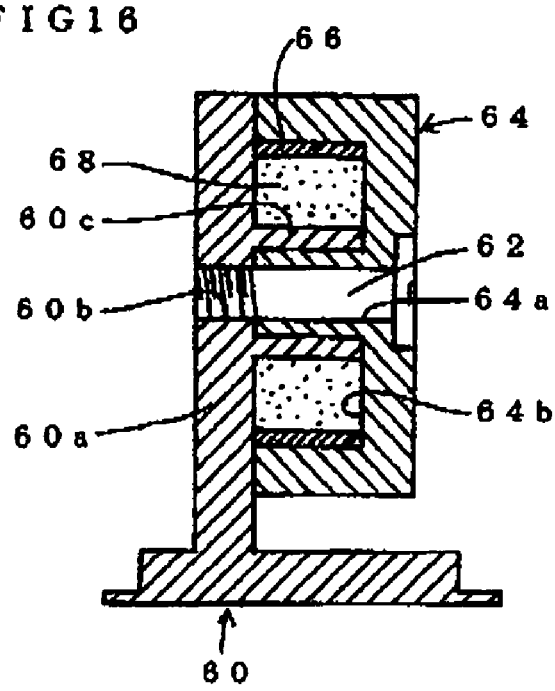
FIG. 16 is a sectional view taken along the arrow-carrying line F—F in FIG. 15.

A fifth embodiment of the present invention will further be described with reference to FIGS. 15 and 16. FIG. 15 is a partially cutaway front view of a part of the fifth embodiment of the antenna device according to the present invention. FIG. 16 is a sectional view taken along the arrow-carrying line F—F in FIG. 15.

Referring to FIGS. 15 and 16, a standing portion 60*a* of an antenna base member 60 is provided with a threaded hole 60*b* for a fixing bolt 62 so that the threaded hole extends horizontally. The standing portion 60*a* is provided at one side thereof with a spring fixing portion 60*c* coaxial with the threaded hole 60*b* and having an inner surface. An antenna base end portion 64 is provided with a bolt hole 64*a* through which the fixing bolt 62 can be inserted, and an annular recess 64*b* coaxial therewith. An inner wall of this annular recess 64*b* can be inserted into the inside of a spring fixing portion 60*c* of the antenna base member 60. A retaining projection 64*c*, which extends radially toward the axis of the antenna base end portion, is provided on an inner circumferential surface of an outer side wall of the annular recess 64*b*. To the spring fixing portion 60*c* of the antenna base member 60, an elastic member 66 made of a plate spring, which is elastically engaged with an inner circumferential surface of an outer circumferential wall of the annular recess 64*b* of the antenna base end portion 64, is fixed by screws and the like. Moreover, the elastic member 66 is provided with engagement recesses 66*a*, 66*b* with which the retaining projection 64*c* can be engaged, and these engagement recesses 66*a*, 66*b* are rendered elastically displaceable in the radial direction. In the elastic member 66, compressed urethane rubber 68 is packed.

The antenna base member 64 is combined with the antenna base member 60 having the elastic member 66 fixed thereto and urethane rubber 68 provided therein, and the antenna base member and antenna base end portion are fixed to each other by the fixing bolt 62 screwed thereto. The purpose of tightening of this fixing bolt 62 is to prevent the antenna base end portion 64 from coming off from the antenna base member 60, and the antenna base end portion 64 is provided pivotably with a pivotal movement thereof restricted by the fixing bolt 62 and the inner surface of the spring fixing portion 60*c*.

In the fifth embodiment of such a construction, the antenna is retained in a predetermined posture with the retaining projection 64*c* of the antenna base end portion 64 engaged with the engagement recesses 66*a*, 66*b* of the elastic member 66. When the elastic member is disengaged from the engagement recesses against the elastic force, the turning of the antenna is allowed. The fifth embodiment can form a click mechanism wholly in the antenna base end portion 64 in the same manner as the first embodiment.

Figure 17:
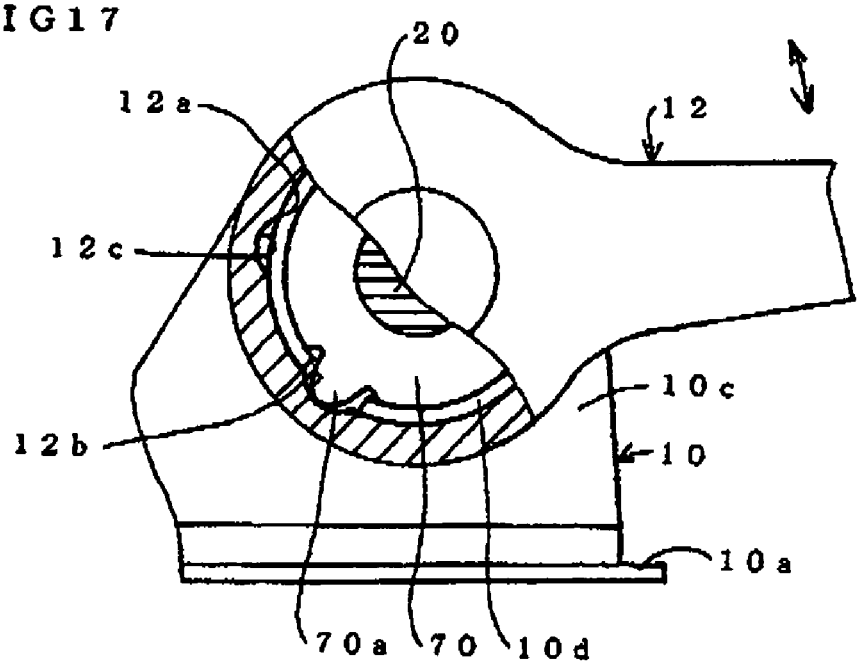
FIG. 17 is a partially cutaway front view of a sixth embodiment of the antenna device according to the present invention.

A sixth embodiment of the present invention will now be described with reference to FIG. 17. FIG. 17 is a partially cutaway front view of the sixth embodiment of the antenna device according to the present invention.

The difference between the sixth embodiment shown in FIG. 17 and the first embodiment resides in that, instead of the elastic member 16 made of the plate spring and urethane rubber 18, an elastic member 70 having a shape substantially identical with that of a combination of these two parts and made of a rubber material and the like having an elasticity and a frictional resistance is provided. A projection of the elastic member 70 extends from a cutoff portion of a cylindrical member 10*d* and works as an engagement projection 70*a*. A free end portion of this engagement projection 70*a* is slidingly engaged with an inner circumferential surface of an outer wall of an engagement recess 12*a* of an antenna base end portion 12 when the antenna is turned. Therefore, it is necessary that this free end portion has a frictional resistance. In this sixth embodiment, the same effect as in the first embodiment can also be obtained.

In any of the first to sixth embodiments, two predetermined postures of the antenna, i.e. a substantially horizontal posture and a posture of an angle of inclination of, for example, 45° at which a maximum reception sensitivity are set. The antenna may also be formed so that the antenna can be retained in one or not smaller than three predetermined postures by providing a suitably selected number of retaining or engagement recesses. In the antenna device according to the present invention, the antenna can be retained in a predetermined posture by only the elastic force of the elastic member, so that it is not always necessary to provide the urethane rubber which gives the antenna a pivotal resistance. The elastic member is not limited to those employed in the above-described embodiments. The elastic members of any shapes serve the purpose as long as the elastic members have a structure capable of engaging the engagement portion and retaining portion with each other elastically. Moreover, it may be understood easily that any materials for the elastic member can meet the purpose as long as the materials have an elastic force. Furthermore, in addition to the structure in which the engagement portion is provided on the elastic member to render the elastic member elastically displaceable in the radial direction thereof, a structure in which the retaining portion can also be elastically displaced in the radial direction thereof alone may be provided.

INDUSTRIAL APPLICABILITY

In the antenna device according to the present invention described above, the engagement projection is elastically deformed with respect to a force in the antenna turning direction the level of which is not lower than a predetermined level, and disengaged from the retaining recess. The engagement projection is elastically engaged with the inner circumferential surface of the engagement recess with the engagement projection left elastically displaced, by a further force exerted on the antenna in the turning direction thereof, and the turning of the antenna is allowed. When the antenna is turned to a position in which a predetermined posture of an angle of inclination of, for example, 45° at which an optimum reception sensitivity is obtained, the engagement projection is opposed to the second-mentioned retaining recess, which is provided in the inner circumferential surface of the engagement recess, and engaged therewith, so that the antenna is retained in a predetermined posture of a suitable angle of inclination. In the antenna device according to the present invention, a so-called click mechanism for retaining the antenna in a predetermined posture is made of a substantially annular elastic member, i.e. a plate spring. Therefore, the antenna device has a very simple construction, and has a small number of parts, so that the antenna device is conveniently formed to small weight. Moreover, the click mechanism can be wholly incorporated in the antenna base end portion.

The invention claimed is:

1. An antenna device in which an antenna base end portion is provided pivotably with respect to an antenna base member with an antenna retained in a predetermined posture, characterized in that one of the antenna base member and antenna base end portion is provided with an elastic member having an engagement portion capable of being elastically displaced in the radial direction with respect to an axis of a pivotal movement thereof so that the elastic member is not relatively turned, the other of the antenna base member and antenna base end portion being provided with a slide engagement section with which the elastic member elastically deformed by a turning movement of the antenna is slidingly engaged, the slide engagement section being provided with a retaining part with which the mentioned engagement section is engaged by the elastic force of the elastic member with the antenna in a predetermined posture.

2. An antenna device in which an antenna base end portion is provided pivotably with respect to an antenna base member with an antenna retained in a predetermined posture, characterized in that the antenna base member is provided with an elastic member having an engagement projection which extends radially with respect to an axis of a pivotal movement of the antenna, and which can be elastically deformed in the radial direction, in such a manner that the elastic member is not turned relatively, the antenna base end portion being provided with a slide engagement section with which the engagement projection elastically deformed by a turning movement of the antenna is slidingly engaged, the slide engagement section being allowable to be provided with a retaining recess with which the engagement projection is engaged by an elastic force thereof with the antenna in a predetermined posture.

3. An antenna device according to claim 2, wherein the antenna device is formed by providing the antenna base member with a cylindrical member a part of an outer circumferential surface of which is cut off, providing a substantially annular elastic member, which has an engagement projection extending in the radial direction of the cutoff portion, in the cylindrical member, providing the antenna base end portion with an engagement recess engaged with the outer circumferential surface of the cylindrical member and thereby forming an inner circumferential surface thereof into the slide engagement section, and providing an inner circumferential surface of the engagement recess with a retaining recess with which the engagement projection is engaged.

4. An antenna device according to claim 3, wherein the annular elastic member may be provided therein with urethane rubber in a compressed state so that the urethane rubber is elastically engaged with a bottom surface of the engagement recess of the antenna base end portion.

5. An antenna device in which an antenna base end portion is provided pivotably with respect to an antenna base member with an antenna retained in a predetermined posture, characterized in that the antenna base end portion is provided with an elastic member having an engagement projection which extends radially with respect to an axis of a pivotal movement of the antenna, and which can be elastically deformed in the radial direction, in such a manner that the elastic member is not turned relatively, the antenna base member being provided with a slide engagement section with which the engagement projection elastically deformed by a turning movement of the antenna is slidingly engaged, the slide engagement section being allowable to be provided with a retaining recess with which the engagement projection is engaged by an elastic force thereof with the antenna in a predetermined posture.

* * * * *